US011735890B2

(12) United States Patent
Strangfeld et al.

(10) Patent No.: US 11,735,890 B2
(45) Date of Patent: Aug. 22, 2023

(54) OVERVOLTAGE PROTECTION APPARATUS AND MODULAR OVERVOLTAGE PROTECTION SYSTEM

(71) Applicant: DEHN SE, Neumarkt i.d.OPf. (DE)

(72) Inventors: Uwe Strangfeld, Nuremberg (DE); Georg Wittmann, Lauterhofen (DE); Richard Daum, Neumarkt (DE); Stefan Schön, Seubersdorf (DE)

(73) Assignee: DEHN SE, Neumarkt i.d. OPf. (DE)

( * ) Notice: Subject to any disclaimer, the term of this patent is extended or adjusted under 35 U.S.C. 154(b) by 47 days.

(21) Appl. No.: 17/603,384

(22) PCT Filed: Apr. 22, 2020

(86) PCT No.: PCT/EP2020/061252
§ 371 (c)(1),
(2) Date: Oct. 13, 2021

(87) PCT Pub. No.: WO2020/216806
PCT Pub. Date: Oct. 29, 2020

(65) Prior Publication Data

US 2022/0209509 A1 Jun. 30, 2022

(30) Foreign Application Priority Data

Apr. 25, 2019 (DE) ..... 102019110745.8

(51) Int. Cl.
*H01T 1/14* (2006.01)
*H01H 37/08* (2006.01)
*H01T 1/12* (2006.01)

(52) U.S. Cl.
CPC ..... *H01T 1/14* (2013.01); *H01H 37/08* (2013.01); *H01T 1/12* (2013.01)

(58) Field of Classification Search
CPC ..... H01T 1/14; H01T 1/12; H01H 37/08
See application file for complete search history.

(56) References Cited

U.S. PATENT DOCUMENTS

2017/0047734 A1* 2/2017 Jankowski ..... H01F 27/343
2020/0144012 A1* 5/2020 Berg ..... H01H 71/0207

FOREIGN PATENT DOCUMENTS

DE 102007042991 A1 12/2008 ..... H01C 7/12
DE 102008026555 A1 12/2009 ..... H01T 1/14

(Continued)

OTHER PUBLICATIONS

The Notification Concerning Transmittal of International Preliminary Report on Patentability (Chapter I of the Patent Cooperation Treaty), in English, dated Nov. 4, 2021, which was issued by the International Bureau of WIPO in Applicant's corresponding international PCT application having Serial No. PCT/EP2020/061252, filed on Apr. 22, 2020.

(Continued)

*Primary Examiner* — Adolf D Berhane
*Assistant Examiner* — Afework S Demisse
(74) *Attorney, Agent, or Firm* — Bodner & O'Rourke, LLP; Gerald T. Bodner; Christian P. Bodner

(57) ABSTRACT

A surge protection device comprises at least one disconnecting device provided in a housing, a heat-conducting element, an actuating element for actuating an indicating device, and a locking element, the heat-conducting element being in contact with the housing. The actuating element is fastened to the heat-conducting element by means of the locking element, and the fastening is configured such that when a predetermined temperature at the locking element is exceeded, the locking element is detached from the heat-conducting element and/or from the actuating element and releases the actuating element.

14 Claims, 4 Drawing Sheets

(56) References Cited

FOREIGN PATENT DOCUMENTS

Figure 1:
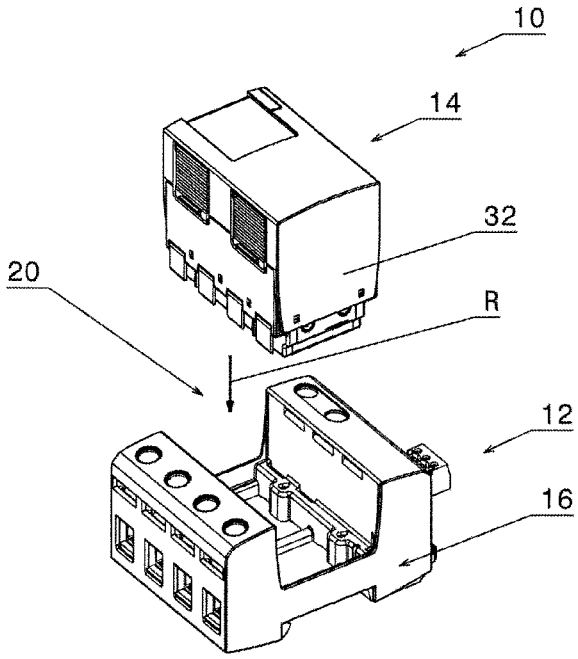

| | | | | |
|---|---|---|---|---|
| DE | 102015114953 | A1 | 3/2017 | ..... H01T 1/12 |
| EP | 2602805 | A1 | 6/2013 | ..... H01C 7/12 |
| WO | WO2008068115 | A1 | 6/2008 | ..... H01H 83/10 |

OTHER PUBLICATIONS

The English translation of the International Preliminary Report on Patentability (Chapter I of the Patent Cooperation Treaty), dated Sep. 28, 2021, which was issued by the International Bureau of WIPO in Applicant's corresponding international PCT application having Serial No. PCT/EP2020/061252, filed on Apr. 22, 2020.

The Written Opinion of the International Searching Authority, in English, dated Jul. 6, 2020, which was issued by the International Bureau of WIPO in Applicant's corresponding international PCT application having Serial No. PCT/EP2020/061252, filed on Apr. 22, 2020.

The International Search Report, in English, dated Jul. 6, 2020, which was issued by the International Bureau of WIPO in Applicant's corresponding international PCT application having Serial No. PCT/EP2020/061252, filed on Apr. 22, 2020.

* cited by examiner b)

b)

OVERVOLTAGE PROTECTION APPARATUS AND MODULAR OVERVOLTAGE PROTECTION SYSTEM

The invention relates to a surge protection device, in particular of type 1, type 2 or a combination of type 1 and 2, and to a modular surge protection system, in particular of type 1, type 2 or a combination of type 1 and 2.

Surge protection devices of type 1 serve to protect the building entrance, e.g. in the event of lightning strokes. Known are surge protection devices of type 1, which are compact in design, i.e. constitute a unit mounted as a whole.

Surge protection devices of type 2 are arranged further inside the building and may also be compact in design.

Such surge protection devices may be provided with a so-called collective indicator, i.e. an optical indicator regarding the state of the device, and with a remote signaling switch.

However, the disadvantage in such compact surge protection devices is that the entire unit always has to be replaced as soon as a defect occurs, e.g. after a lightning stroke. It is therefore the object of the invention to provide a surge protection device and a modular surge protection system which can both actuate a collective indicator and/or a remote signaling switch, and is modular.

To achieve the object, a surge protection device, in particular of type 1, type 2 or a combination of type 1 and 2 is provided, comprising at least one disconnecting device provided in a housing, a heat-conducting element, an actuating element for actuating an indicating device, and a locking element, the heat-conducting element being in contact with the housing. The actuating element is fastened to the heat-conducting element by means of the locking element, and the fastening is formed by the locking element such that when a predetermined temperature at the locking element is exceeded, the locking element is detached from the heat-conducting element and/or from the actuating element and releases the actuating element.

By using the heat-conducting element, it is possible to use the heat generation of the disconnecting device for releasing an actuating element. The actuating element can in turn then be used to actuate a collective indicator, here in the form of an indicating device, or a remote signaling switch.

The heat-conducting element is in particular not a current-carrying part, even in the event of an overvoltage.

In the context of this invention, "in contact" means that there is a good heat-conducting connection, in particular in that the heat-conducting element touches the housing, in particular from the outside, and/or in that merely a heat-conducting paste, a heat-conducting adhesive or the like is provided between the heat-conducting element and the housing.

In particular, the actuating element is movable between an arrested position and a released position, the locking element fixing the actuating element in the arrested position, and the actuating element being adapted to be pretensioned in the arrested position. Due to the pretension, a direct actuation and thus a short response time are achieved. For example, the pretension acts towards the indicating device.

In one embodiment, the surge protection device may have a spring which pretensions the actuating element.

For example, the surge protection device has exactly one or at least two, in particular three or four disconnecting devices each having a housing, the heat-conducting element being in contact with at least two, in particular all of the housings. In this way, an OR circuit is realized by the heat-conducting element.

To allow a reliable and secure disconnection, the at least one disconnecting device may have a spark gap, and the housing may surround the spark gap. The spark gap is for example a horn spark gap.

In one embodiment of the invention, the locking element includes a temperature-sensitive material, in particular a solder the melting point of which determines the predetermined temperature, as a result of which the predetermined temperature and thus the release threshold can be accurately adjusted.

The temperature-sensitive material is for example a low temperature solder, in particular having a melting point between 110° C. and 140° C., for example a melting point of 138° C.

To ensure a reliable actuation, the locking element may comprise a component, in particular a circuit board which is fastened to one of the actuating element and the heat-conducting element by means of the heat-sensitive material, in particular wherein the component is permanently fastened to the other one of the actuating element and the heat-conducting element.

In one configuration of the invention, the heat-conducting element is a metal sheet, in particular made of copper, as a result of which a reliable heat transfer is also achieved between more distant disconnecting devices and the locking element.

To improve the thermal contact with the housing, the heat-conducting element may have a spring section which urges the heat-conducting element against the housing. The spring section for example supports on the frame and/or on the device housing.

The surge protection device may have a frame and/or a device housing to which the heat-conducting element is fastened, to which the at least one disconnecting device is fastened, and/or on which the actuating element is guided, a compact design being thus achieved.

To visually indicate the state of the surge protection device, the surge protection device may have an indicating device including an indicating area, a first indicating surface fixed in the indicating area, and a movable second indicating surface. The second indicating surface may be movable between an arrested position, in which the second indicating surface overlaps the first indicating surface, and a released position, in which the second indicating surface is arranged offset with respect to the first indicating surface. The indicating device may also be referred to as collective indicator.

For example, the second indicating surface is formed on a movable indicating element, wherein in the arrested position, the indicating element is arrested and pretensioned by a spring in the direction of the released position, the arresting of the indicating element being released by the actuating element in the released position. In this way, the actuating element may actuate the indicating device.

To actuate both an easily readable optical indicator and a remote signaling switch, the actuating element and the indicating element may for the most part be arranged on different sides of the surge protection device.

For example, the indicating element, for the most part, i.e. except for a free end, and also the indicating area are provided on the top surface of the surge protection device, whereas the actuating element is provided on a side face of the surge protection device.

The directions of motion of the indicating element and of the actuating element may be perpendicular to each other, for example in the transverse and in the upward direction.

The object is further achieved by a modular surge protection system, in particular of type 1, type 2 and a combination of type 1 and 2, comprising a base part and a surge protection device as previously described, the base part having an accommodation for the surge protection device and a pretensioning device. The pretensioning device has a spring and a movable tensioning part, which partially projects into the accommodation, the tensioning part engaging the actuating element of the surge protection device, and the spring pretensioning the actuating element via the tensioning part when the surge protection device is inserted in the base part.

The features and advantages described for the surge protection device also equally apply to the modular surge protection system.

In the context of the present invention, a spring is generally understood to mean elastic components which are adapted to provide a restoring force.

For example, the surge protection system has a remote signaling switch, the remote signaling switch including the spring, in particular the pretensioning device. The spring thus serves both to actuate the remote signaling switch and to actuate the indicating device, thus saving components.

Figure 2:
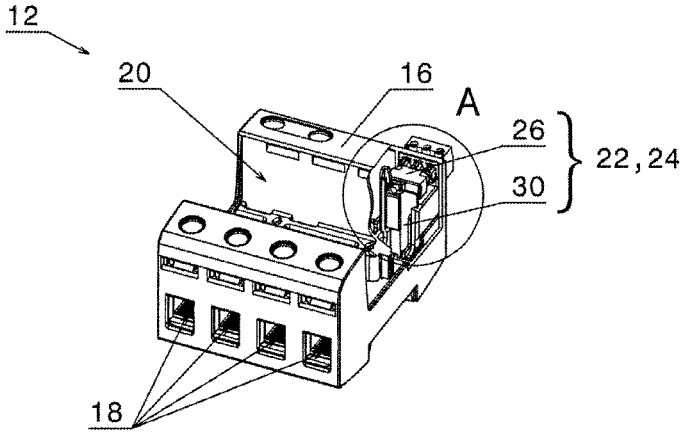
Figure 2:
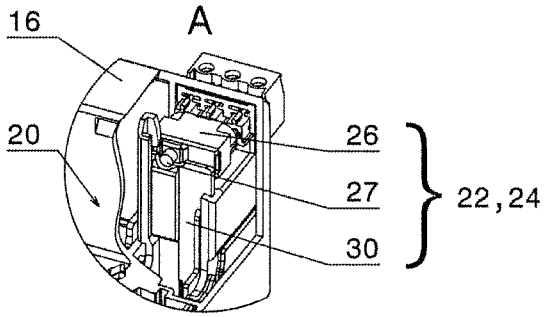
Figure 3:
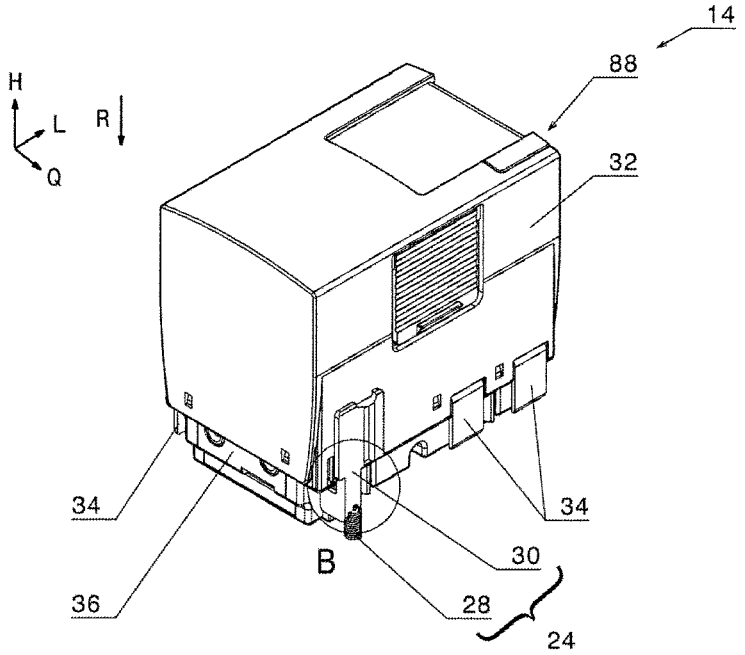
Figure 3:
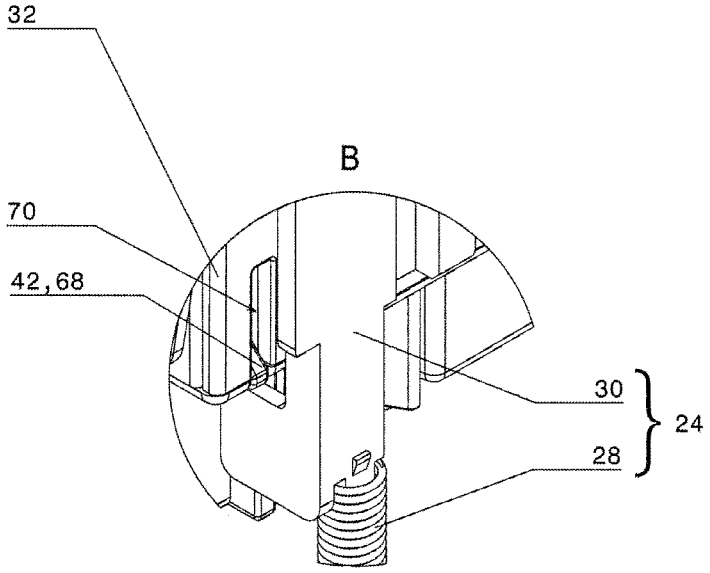
Figure 4:
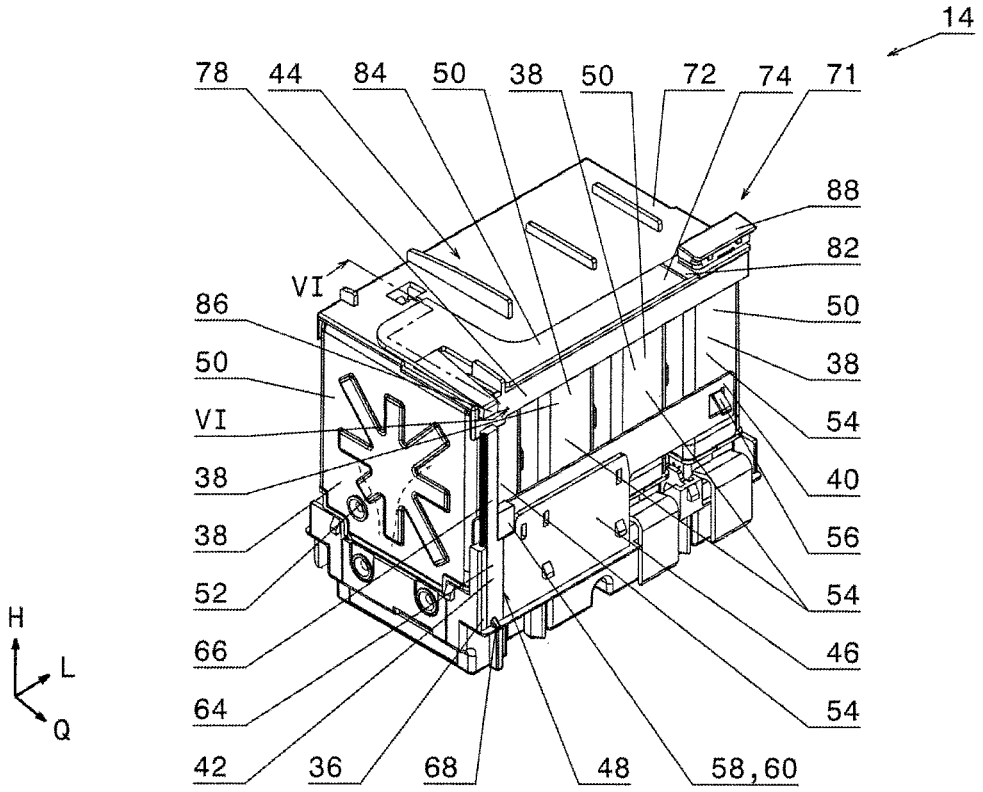
Figure 5:
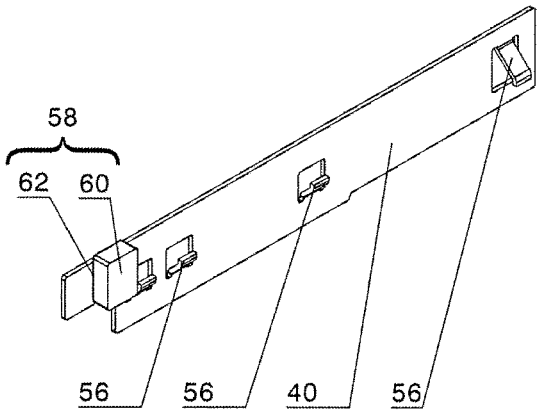
Figure 6:
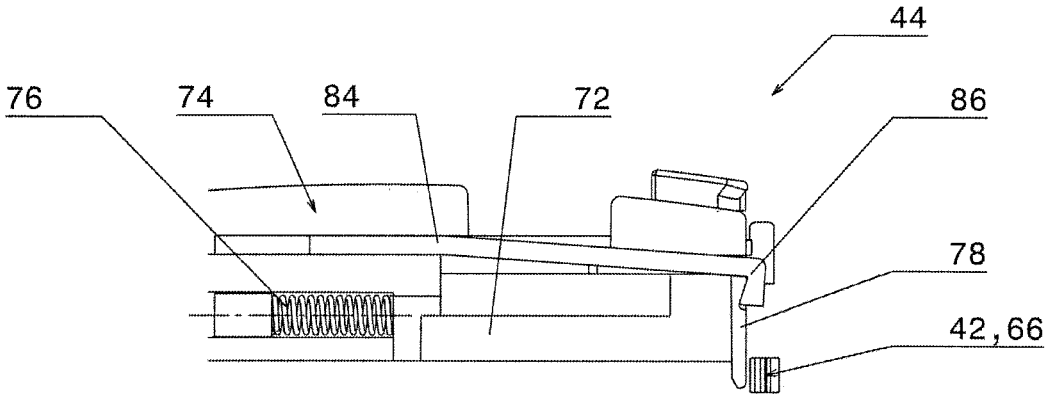
Figure 7:
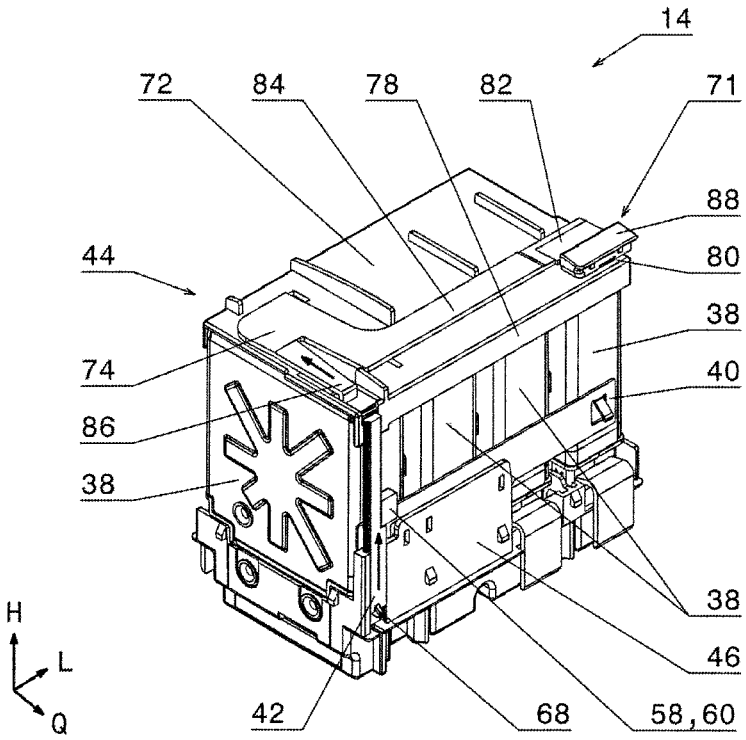

Further features and advantages of the invention will become apparent from the description below and from the accompanying drawings to which reference is made and in which:

FIG. 1 shows a modular surge protection system according to the invention having a surge protection device according to the invention;

FIG. 2*a* shows a base part of the surge protection system according to FIG. 1, FIG. 2*b* shows an enlarged view of a section of the base part according to FIG. 2*a*, FIG. 3*a* shows the surge protection device of the surge protection system according to FIG. 1 and a pretensioning device of the component, FIG. 3*b* shows an enlarged view of the contact point between the pretensioning device and the surge protection device according to FIG. 3*a*, FIG. 4 shows a perspective view of the open surge protection device according to FIG. 1 in the arrested state, FIG. 5 shows a heat-conducting element of the surge protection device according to FIG. 4, FIG. 6 shows a partial sectional view of the surge protection device along the line VI-VI of FIG. 4, and FIG. 7 shows the surge protection device according to FIG. 4 in the triggered state.

FIG. 1 shows a modular surge protection system 10 according to the invention, having a base part 12 and a surge protection device 14.

The surge protection system 10 is modular to the effect that the surge protection device 14 can be removed from the base part 12 and can be replaced, for example after a lightning stroke.

The surge protection system 10 and the surge protection device 14 are a type 1 surge protection system and a type 1 surge protection device, respectively.

In FIG. 2*a*, the base part 12 is illustrated separately and includes a housing 16 having terminals 18 and an accommodation 20.

The surge protection device 14 can be inserted into an accommodation 20 in a direction of insertion R and can be retained there, the surge protection system 10 being thus ready for operation.

As shown in FIG. 2*b*, a remote signaling switch 22 (FM switch) which comprises a pretensioning device 24 is provided within the housing 16.

The remote signaling switch 22 furthermore comprises a microswitch 26 having a release 27 which can be integrated into a building management system, the switch cabinet control or similar to indicate the state of the surge protection system 10 or the surge protection device 14.

The pretensioning device 24 comprises a spring 28 and a movable tensioning part 30 which extends through the housing 16 into the accommodation 20.

The tensioning part 30 is configured to be movable in the direction of insertion R. Furthermore, the tensioning part 30 can actuate the microswitch 26, more specifically the microswitch 27.

In FIGS. 3*a* and 3*b*, the surge protection device 14 and the pretensioning device 24 are shown separately.

The surge protection device 14 has a device housing 32 and contacts 34 which are not covered by the device housing 32. When the surge protection device 14 is inserted into the accommodation 20, the surge protection device 14 is electrically connected to the terminals 18 of the base part 12 by means of the contacts 34.

In FIG. 4, the surge protection device 14 is illustrated without the device housing 32 and the contacts 34 for a better overview.

The surge protection device 14 has a frame 36, a plurality of disconnecting devices 38, here four, a heat-conducting element 40, an actuating element 42, and an indicating device 44.

It is of course also conceivable to provide exactly one, two, three or more than four disconnecting devices 38.

The frame 36 in particular serves as a bottom of the surge protection device 14 to which the contacts 34, the disconnecting devices 38, the heat-conducting element 40 and the actuating element 42 are fastened or on which they are guided.

The frame 36 comes in direct contact with the bottom of the accommodation 20 and is complementary to the accommodation 20.

For fastening the heat-conducting element 40 and the actuating element 42, the frame 36 has a side wall 46 which extends at least partially along the longitudinal direction L of the surge protection device 14.

In the context of the present invention, the upward direction H of the surge protection device 14 or the surge protection system 10 is intended to extend in the opposite direction to the direction of insertion R, in which the surge protection device 14 is inserted into the base part 12. This is for illustrative purposes only and corresponds to the orientation of the figures. However, in the orientation in which the surge protection system 10 is usually mounted, the upward direction H extends horizontally.

The directional indications "up" and "down" also refer to the orientations illustrated in the figures.

Perpendicular to the upward direction H, the surge protection device 14 has a transverse direction Q and a longitudinal direction L which correspond to the direction of the shorter or longer side edge of the surge protection device 14, respectively.

A guide 48 in the form of a slot is formed in the side wall 46 in the upward direction H of the surge protection device 14.

The disconnecting devices 38 have a housing 50 in which a respective spark gap 52 (indicated by a dashed line in FIG. 4), for example a horn spark gap is formed. The housings 50 are for example made of metal.

The disconnecting devices 38 are arranged in alignment one behind the other in the longitudinal direction L, the walls 54 of the housings 50 lying in particular in a common plane.

The heat-conducting element 40 which is shown in an enlarged view in FIG. 5 is in contact with each of the housings 50 via the walls 54. The heat-conducting element 40 has spring sections 56 and touches the housings 50, more specifically the walls 54, directly or only by means of a heat-conducting paste, a heat-conducting adhesive or similar. The heat-conducting element 40 is thus thermally coupled to the housing 50.

The heat-conducting element 40 is for example a metal sheet, in particular made of copper, a copper alloy or an aluminum alloy. Other materials having a good thermal conductivity are of course also conceivable.

The heat-conducting element 40 is arranged between the disconnecting devices 38 and the device housing 32 and partially the side wall 46, and also extends in the area of the guide 48 of the side wall.

The heat-conducting element 40 is supported on the frame 36 or the side wall 46 and on the device housing 32 by means of the spring sections 56 and is thus pressed against the housing 50 to ensure a good thermal contact.

A locking element 58 is provided on the heat-conducting element 40 in the region of the guide 48.

The locking element 58 includes as a component 60 a circuit board made of FR-4 and a temperature-sensitive material 62.

The circuit board has no electrically conducting structures.

The temperature-sensitive material 62 is for example a low-temperature solder, in particular having a melting point between 110° C. and 140° C., for example a melting point of 138° C.

In the example embodiment shown, the component 60 is detachably fastened to the heat-conducting element 40 and permanently fastened to the actuating element 42 by means of the temperature-sensitive material 62.

The actuating element 42 has a first section 64 and an adjoining second section 66. The first section 64 is configured to be wider than the second section 66, such that a step in which the locking element 58, more specifically the component 60 rests is formed at the transition between the first section 64 and the second section 66.

The first section 64 is received in the guide 48 and is for example configured to be complementary to the guide 48. The guide 48 and the first section 64 can form a dovetail joint.

The actuating element 42 is movable in the guide 48 in the upward direction H between an arrested position (FIG. 4) and a released position (FIG. 7).

The arrangement of the locking element 58 on the step prevents the actuating element 42 from moving along the upward direction H, such that the actuating element 42 is fixed in the arrested position.

At the lower end of the first section 64, i.e. the end facing away from the second section 66, the first section 64 has a lug 68 which is arranged in a gap 70 of the device housing 32, as illustrated in FIG. 3*b*.

It can be clearly seen that the lug 68 engages the tensioning part 30 of the pretensioning device 24. When the surge protection device 14 is completely inserted into the accommodation 20, the spring 28 of the pretensioning device 24 is tensioned by the actuating element 42 and the tensioning part 30. In other words, the actuating element is then pretensioned by the spring 28 in the upward direction H opposite the direction of insertion R.

The indicating device 44 is provided on the top surface of the surge protection device 14, i.e. above the disconnecting devices 38.

The indicating device 44 includes an indicating area 71, a base plate 72, an indicating element 74 movable with respect to the base plate 72, and a spring 76.

The device housing 32 of the surge protection device 14 can furthermore have an inspection window 88 in the indicating area 71 which allows a view on the indicating area 71.

In the example embodiment shown, the base plate 72 covers the disconnecting devices 38 towards the top and rests on the housings 50.

At least one of the edges 78 of the base plate 72 extending in the longitudinal direction L is angled downwards and extends in the direction of the upward direction H.

The indicating element 74 is configured to be movable in the transverse direction Q with respect to the base plate 72 and includes a main section 84 substantially parallel to the base plate 72, and an adjoining fastening section 86.

The indicating element 74 is guided in the transverse direction Q in the base plate 72 and may assume an arrested position and a released position.

The part of the base plate 72 located in the indicating area 71 forms a fixed first indicating surface 80. The first indicating surface 80 is red, for example, the entire base plate 72 being in particular red.

The main section 84 of the indicating element 74 has a second indicating surface 82 of the indicating device 44, which is therefore also movable. The second indicating surface 82 is provided at the end of the main section 84 which faces away from the fastening section 86.

The second indicating surface 82, in particular the entire indicating element 74 is green.

In the arrested position shown in FIG. 4, the second indicating surface 82 overlaps the first indicating surface 80, such that the green second indicating surface 82 can be seen through the inspection window 88.

FIG. 6 schematically shows the surge protection device 14 in the area of the indicating device 44 in the arrested position, such that the spring 76 is visible.

The spring 76 is provided in the base plate 72 and urges the indicating element 74 with a force in the transverse direction Q. The spring 76 in particular engages the main section 84.

It can be clearly seen in the arrested position shown in FIG. 6 that the free end of the fastening section 86 is angled. This angled end engages the edge 78 of the base plate 72 and thus prevents a movement of the indicating element 74 in the transverse direction Q.

To this end, the edge 78 of the base plate 72 has an undercut in which the end of the fastening end 86 engages.

As can also be clearly seen in FIGS. 4 and 6, the end of the fastening section 86 is located above the actuating element 42 in the upward direction H.

In the situation shown in FIG. 4, both the actuating element 42 and the indicating element 74 are located in a first pretensioned and arrested position.

This is the normal position of the surge protection device 14 when all of the disconnecting devices 38 are operational.

When the surge protection system 10 or the surge protection device 14 is operational, a high voltage is reduced by at least one of the disconnecting devices 38. In the event of particularly high overvoltages, the appropriate disconnecting device 38 may lose its functionality, which is communicated by the indicating device 44 and the remote signaling switch 22. To this end, both the indicating device 44 and the remote signaling switch 22 are triggered.

In the event of an overvoltage, a large amount of heat is generated in the disconnecting devices 38, for example due to an arc. This causes the housing 50 of the appropriate disconnecting device 38 or, if a plurality of disconnecting devices 38 are involved in the voltage reduction, the housings 50 of a plurality of disconnecting devices 38 to heat up.

Due to the good thermal contact between the housings 50 and the heat-conducting element 40, the heat-conducting element 40 is heated, more specifically by the generated heat of each of the disconnecting devices 38.

Due to the high thermal conductivity of the heat-conducting element 40 itself, the location of the heat-conducting element where the locking element 58 is provided also heats up. As soon as this location, more specifically the temperature-sensitive material 62 reaches a predetermined temperature which in this case is determined by the melting point of the temperature-sensitive material 62, the temperature-sensitive material 62 dissolves, such that the component 60 is no longer connected to the heat-conducting element 40.

In other words, the heat-conducting element 40 absorbs the generated heat of all disconnecting devices 38 and supplies it to the locking element 58. The heat-conducting element 40 thus constitutes an OR-operation of the disconnecting devices 38.

As soon as the component 60 is released from the heat-conducting element 40, it is no longer able to hold the actuating element 42 in the arrested position against the spring force of the spring 28 of the pretensioning device 24.

Therefore, the actuating element 42 is moved in the upward direction H towards the indicating device 44 by the pretensioning device 24, more specifically the tensioning part 30, and assumes its released position shown in FIG. 7.

At the same time, the microswitch 26, more specifically the release 27 is actuated by the tensioning part 30 such that the remote signaling 22 is actuated.

In the released position, the actuating element 42 extends in the upward direction H almost over the entire edge 78 of the base plate 72. As it moves, the actuating element 42 detaches the end of the fastening section 86 from the edge 78, thus releasing the arresting of the indicating element 74.

Therefore, the indicating element 74 is now moved by the spring 76 in the transverse direction Q into its released position.

In the released position, the second indicating surface 82 is offset with respect to the first indicating surface 80, such that the first indicating surface 80 is no longer covered.

In other words, only the first indicating surface 80 is still in the indicating area 71, such that a red area can be seen through the inspection window 88.

The red first indicating surface 80 indicates a defect in at least one of the disconnecting devices 38, such that the surge protection device 14 must be replaced.

In this way, both the remote signaling switch 22 and the indicating device 44 are actuated as soon as one of the disconnecting devices 38 is defective.

Both the indicating device 44 and the remote signaling switch 22 are triggered and actuated by the same assembly composed of the locking element 58 and the pretensioning device 24, so that cases in which the indicators do not match cannot occur.

Furthermore, activation of the entire actuating mechanism occurs when the surge protection device 14 is inserted into the accommodation 20, so that no additional activities are necessary.

However, it is also conceivable that the surge protection device 14 itself has a spring for generating the pretension of the actuating element 42.

The invention claimed is:

1. A surge protection device, comprising at least one disconnecting device provided in a housing, a heat-conducting element, an actuating element for actuating an indicating device, and a locking element, the heat-conducting element being in contact with the housing, and the actuating element being fastened to the heat-conducting element by means of the locking element, and the fastening via the locking element being configured such that when a predetermined temperature at the locking element is exceeded, the locking element is detached from the heat-conducting element and/or from the actuating element and releases the actuating element, wherein the surge protection device has at least two disconnecting devices each having a housing, the heat-conducting element being in contact with at least two of the housings.

2. The surge protection device according to claim 1, characterized in that the actuating element is movable between an arrested position and a released position, the locking element fixing the actuating element in the arrested position, and the actuating element being adapted to be pretensioned in the arrested position.

3. The surge protection device according to claim 1, characterized in that the surge protection device has three or four disconnecting devices each having a housing, the heat-conducting element being in contact with at least two, in particular all of the housings.

4. The surge protection device according to claim 1, characterized in that the at least one disconnecting device has a spark gap and in that the housing surrounds the spark gap.

5. The surge protection device according to claim 1, characterized in that the locking element includes a temperature-sensitive material, in particular a solder the melting point of which determines the predetermined temperature.

6. The surge protection device according to claim 5, characterized in that the locking element comprises a component, in particular a circuit board which is fastened to one of the actuating element and the heat-conducting element by means of the temperature-sensitive material, in particular wherein the component is permanently fastened to the other one of the actuating element and the heat-conducting element.

7. The surge protection device according to claim 1, characterized in that the heat-conducting element is a metal sheet, in particular made of copper, and/or in that the heat-conducting element has at least one spring section which urges the heat-conducting element against the housing.

8. The surge protection device according to claim 1, characterized in that the surge protection device has a frame and/or a device housing to which the heat-conducting element is fastened, to which the at least one disconnecting device is fastened, and/or on which the actuating element is guided.

9. The surge protection device according to claim 1, characterized in that the surge protection device has an indicating device which includes an indicating area, a first indicating surface fixed in the indicating area, and a movable second indicating surface, the second indicating surface being movable between an arrested position in which the second indicating surface overlaps the first indicating surface, and a released position in which the second indicating surface is arranged offset with respect to the first indicating surface.

10. The surge protection device according to claim 9, characterized in that the second indicating surface is formed on a movable indicating element, the indicating element, in the arrested position, being arrested and pretensioned by a spring in the direction of the released position, wherein in the released position, the arresting of the indicating element is released by the actuating element.

11. The surge protection device according to claim 9, characterized in that the actuating element and the indicating element are for the most part arranged on different sides of the surge protection device.

12. A modular surge protection system comprising a base part and a surge protection device according to claim 1, the base part having an accommodation for the surge protection device and a pretensioning device, the pretensioning device having a spring and a movable tensioning part partially projecting into the accommodation, the tensioning part engaging the actuating element of the surge protection device, and the spring pretensioning the actuating element via the tensioning part when the surge protection device is inserted in the base part).

13. The modular surge protection system according to claim 12, characterized in that the surge protection system has a remote signaling switch, the remote signaling switch including the spring, in particular the pretensioning device.

14. A surge protection device, comprising at least one disconnecting device provided in a housing, a heat-conducting element, an actuating element for actuating an indicating device, and a locking element, the heat-conducting element being in contact with the housing, and the actuating element being fastened to the heat-conducting element by means of the locking element, and the fastening via the locking element being configured such that when a predetermined temperature at the locking element is exceeded, the locking element is detached from the heat-conducting element and/or from the actuating element and releases the actuating element, and wherein the surge protection device has an indicating device which includes an indicating area, a first indicating surface fixed in the indicating area, and a movable second indicating surface, the second indicating surface being movable between an arrested position in which the second indicating surface overlaps the first indicating surface, and a released position in which the second indicating surface is arranged offset with respect to the first indicating surface.

* * * * *